US007063521B2

(12) United States Patent
Huang et al.

(10) Patent No.: US 7,063,521 B2
(45) Date of Patent: Jun. 20, 2006

(54) COLLAPSIBLE HANDGRIP FOR INFLATOR

(76) Inventors: Ying-Che Huang, No. 111, Lane Tzeng-Fu, Tzeng-Tsuo Tsuen, Shiou-Shuei Shiang, Chang-Hua Hsien, 504 (TW); Chun-Ming Huang, No. 111, Lane Tzeng-Fu, Tzeng-Tsuo Tsuen, Shiou-Shuei Shiang, Chang-Hua Hsien, 504 (TW)

( * ) Notice: Subject to any disclaimer, the term of this patent is extended or adjusted under 35 U.S.C. 154(b) by 296 days.

(21) Appl. No.: 10/618,200

(22) Filed: Jul. 10, 2003

(65) Prior Publication Data

US 2005/0008500 A1 Jan. 13, 2005

(51) Int. Cl.
*F04B 39/00* (2006.01)
*F04B 53/00* (2006.01)

(52) U.S. Cl. ..... 417/572; 417/234

(58) Field of Classification Search ..... 417/572, 417/234, 552, 313; 16/111.1, 408–411; D23/231
See application file for complete search history.

(56) References Cited

U.S. PATENT DOCUMENTS 4,569,275 A * 2/1986 Brunet ..... 92/58.1
4,919,600 A * 4/1990 Yang ..... 417/63
5,102,052 A * 4/1992 Demarest et al. ..... 239/355
5,347,913 A * 9/1994 Stepner ..... 92/58.1
5,433,136 A * 7/1995 Lung-Po ..... 92/58.1
5,443,370 A * 8/1995 Wang ..... 417/238
5,476,372 A * 12/1995 Yang ..... 417/553
5,494,411 A * 2/1996 Chuang ..... 417/234
5,655,890 A * 8/1997 Liao ..... 417/234
6,017,196 A * 1/2000 Wu ..... 417/234
6,017,201 A * 1/2000 Yang ..... 417/454
6,164,938 A * 12/2000 Chuang ..... 417/569
6,196,807 B1 * 3/2001 Wu ..... 417/63
6,250,205 B1 * 6/2001 Chuang ..... 92/15
6,257,849 B1 * 7/2001 Wu ..... 417/469
6,345,958 B1 * 2/2002 Chen ..... 417/63
6,464,477 B1 * 10/2002 Wu ..... 417/569
6,506,026 B1 * 1/2003 Wu ..... 417/234
6,602,061 B1 * 8/2003 Chuang ..... 417/572
6,615,704 B1 * 9/2003 Chuang ..... 92/58.1
6,736,619 B1 * 5/2004 Wu ..... 417/572
6,817,060 B1 * 11/2004 Huang et al. ..... 16/111.1
2003/0039553 A1 * 2/2003 Wang ..... 417/63
2004/0156726 A1 * 8/2004 Wu ..... 417/63

* cited by examiner

*Primary Examiner*—William Rodriguez

(57) ABSTRACT

An inflator includes a hollow handgrip and an air cylinder having a shaft. One end of the shaft is connected with a piston in the cylinder and the other end of the shaft is provided with a stud extending out of the cylinder. A bottom wall and an opening are arranged respectively at opposite ends of the handgrip. A tapped hole is formed in the bottom wall for locking the stud. Through the opening, the cylinder may be stored in the handgrip to lessen the volume of the inflator. When using the inflator, a user draws the cylinder out of the handgrip and lock the stud to the tapped hole through the bottom end of the handgrip to thereby extend the shaft. Air is pumped out through an outlet of the cylinder by reciprocal axial motion of the shaft.

3 Claims, 5 Drawing Sheets

COLLAPSIBLE HANDGRIP FOR INFLATOR

BACKGROUND OF THE INVENTION

1. Field of the Invention

The present invention relates to a collapsible handgrip for inflator, such as a bicycle pump.

2. The Prior Arts

A generic collapsible handgrip equipped inflator available in the market is usually provided with a foldable handgrip, which could be stored or carried easily when an inflator is not in use, or, on the contrary, it could be turned out for easy operation.

FIG. 5 shows an inflator equipped with a conventional collapsible handgrip, generally designated with reference character (D), which is pivotally connected to one end of a shaft (B) of an air cylinder (A) through a pivot pin (C). A slot (D1) wider than the diameter of the shaft (B) is formed in a lateral wall of the handgrip (D). When the inflator is not in use, a user may rotate the handgrip (D) relatively to the shaft (B) such that the latter could be received in the handgrip (D) through the slot (D1). Further, the handgrip (D) could be aligned in line with the air cylinder (A) and stored or carried in that manner, or a user could bold the handgrip directly and operate axially to pump out the air inside the cylinder (A) through an outlet at one end thereof. However, the stroke range of the shaft (B) is relatively short due to the limitation of a bottom end (D2) of the handgrip (D). Hence, the volume in the cylinder is reduced and the air ejected is insufficient. Therefore, a preferred manner is to first turn the shaft (B) out of the handgrip (D), then bend the handgrip (D) to form a straight angle with the shaft (B) for improving the stroke range of the shaft (B) and hence the volume of the cylinder. Unfortunately, the L-type operation is rather awkward caused by a force moment between the handgrip (D) and the shaft (B) that would need some more improvements for raising the operation efficiency.

SUMMARY OF THE INVENTION

The present invention is provided to eliminate the drawback of insufficient air volume in the cylinder of an inflator, which is aligned in-line with the handgrip when a collapsible handgrip of a conventional inflator is folded, as the primary object.

The present invention is provided to eliminate the operational awkwardness, which occurs when a collapsible handgrip of a conventional inflator is extended to form an L-type mechanism with a shaft, as another object.

The present invention is provided to improve the portability of an inflator, whose volume cannot be fully minimized when a collapsible handgrip thereof is folded, as yet another object.

In order to realize aforementioned objects and according to an embodiment of the present invention, a handgrip and a shaft are separately disposed. An opening and a tapped hole are arranged at two respective ends of the handgrip, in which the shaft is extended penetratingly through an air cylinder to form a stud at that end, so that the cylinder could be held to enter the handgrip through the opening and fixed by locking the stud to the tapped hole for receiving the cylinder in the handgrip and for minimizing the entire volume of the inflator. A user may draw the cylinder out of the handgrip, then lock the stud to the tapped hole through the other end to extend the length of the shaft for easy operation of inflation without affecting the volume efficiency of the cylinder.

Besides, an additional snap-fastening mechanism between the handgrip and the cylinder built with flange and groove is also provided to enhance the positioning effect when the cylinder is stored in the handgrip.

Compared with a conventional inflator handgrip, the merits of the present invention may be summarized in the following:

(1) The volume efficiency of cylinder is not lowered when the handgrip and the shaft are extended and aligned.

(2) Inflating operation is relatively easy.

(3) A smaller packing volume is obtainable for portability and easy storage.

For more detailed information regarding advantages or features of the present invention, at least an example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
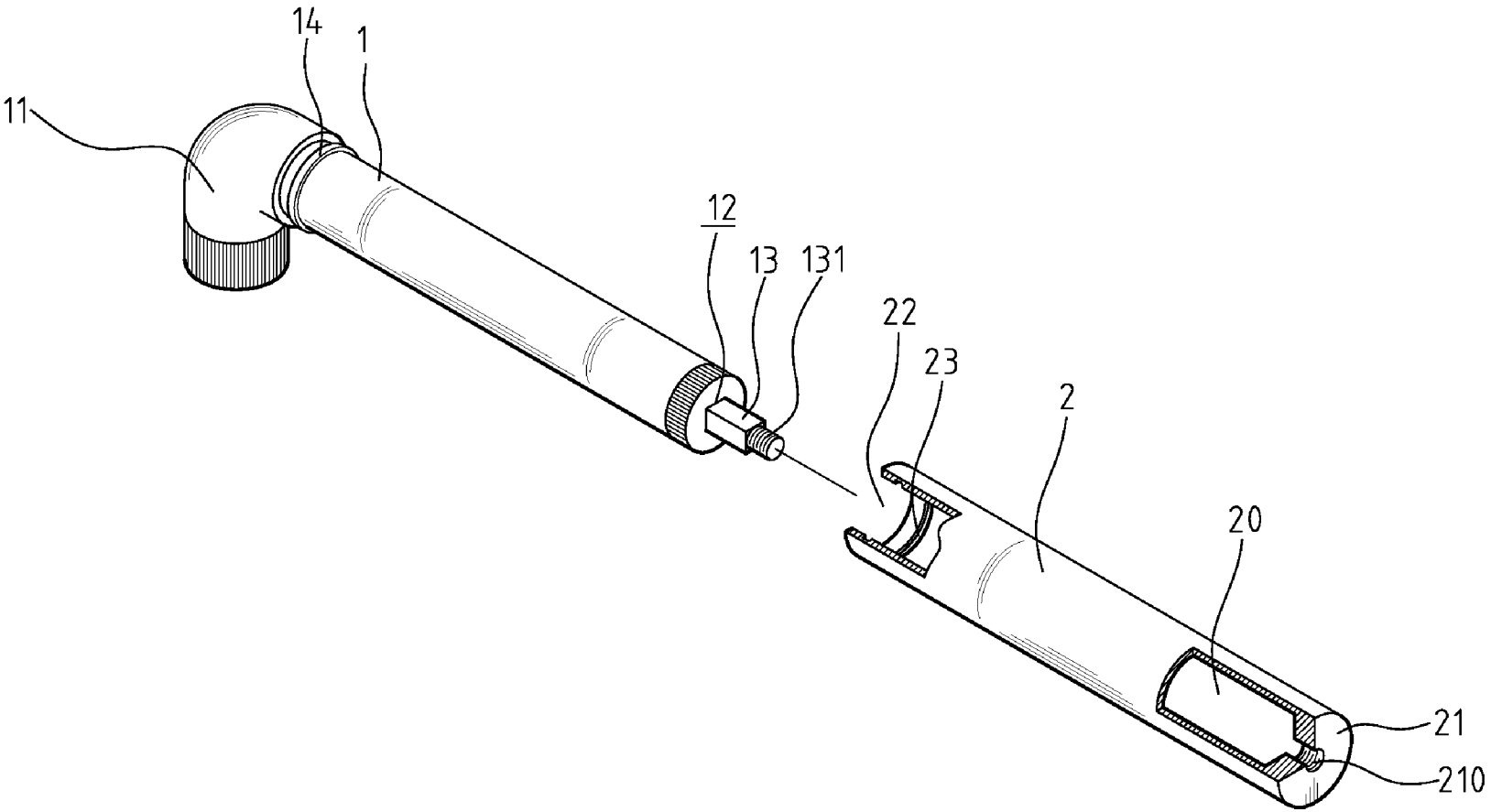
FIG. 1 is a perspective view showing the structure of an air cylinder and a handgrip of the present invention, as well as the separate state thereof.

As shown in FIG. 1, there is an air cylinder 1 and a hollowed cylindrical handgrip 2 included in an inflator according to an embodiment of the present invention. A piston (not shown) in the cylinder 1 is jointed with a shaft 13 having one end extended through a through hole 12 at one end of the cylinder 1, and the same end of the shaft 13 is provided with a stud 131, while an outlet is arranged at the other end of the cylinder 1. In order to avoid any relative rotation between the shaft 13 and the cylinder 1, the cross section of the shaft 13 and its corresponding through hole 12 do not have a circular section. As indicated in FIG. 1, both the cross section of the shaft 13 and the through hole 12 are rectangular. Therefore, the shaft 13 can only perform an axial motion, not a spinning motion, to drive the piston in the cylinder 1 and pump the air inside out through the outlet 11.

The handgrip 2 is a hollow tubular body having an inner space 20, which is approximately equal to the cylinder 1 in length. On two opposite ends of the handgrip 2, there is a bottom wall 21 and an opening 22, respectively, in which a tapped hole 210 is centered in the bottom wall 21 for engaging with the stud 131, and the cylinder 1 is supposed to enter the inner space 20 of the handgrip 2 through the opening 22.

Figure 2:
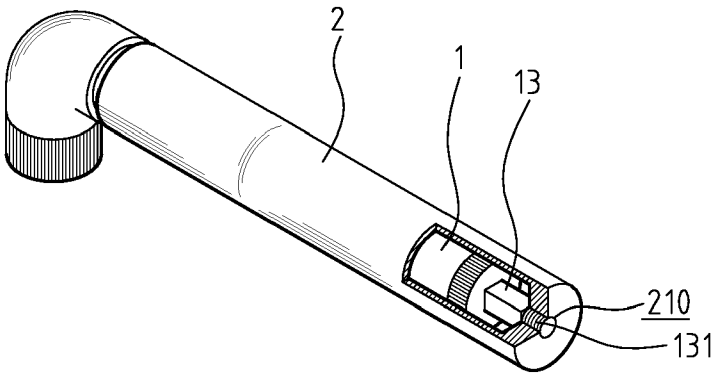
FIG. 2 is a perspective view showing the state when the air cylinder is stored in the handgrip.
Figure 3:
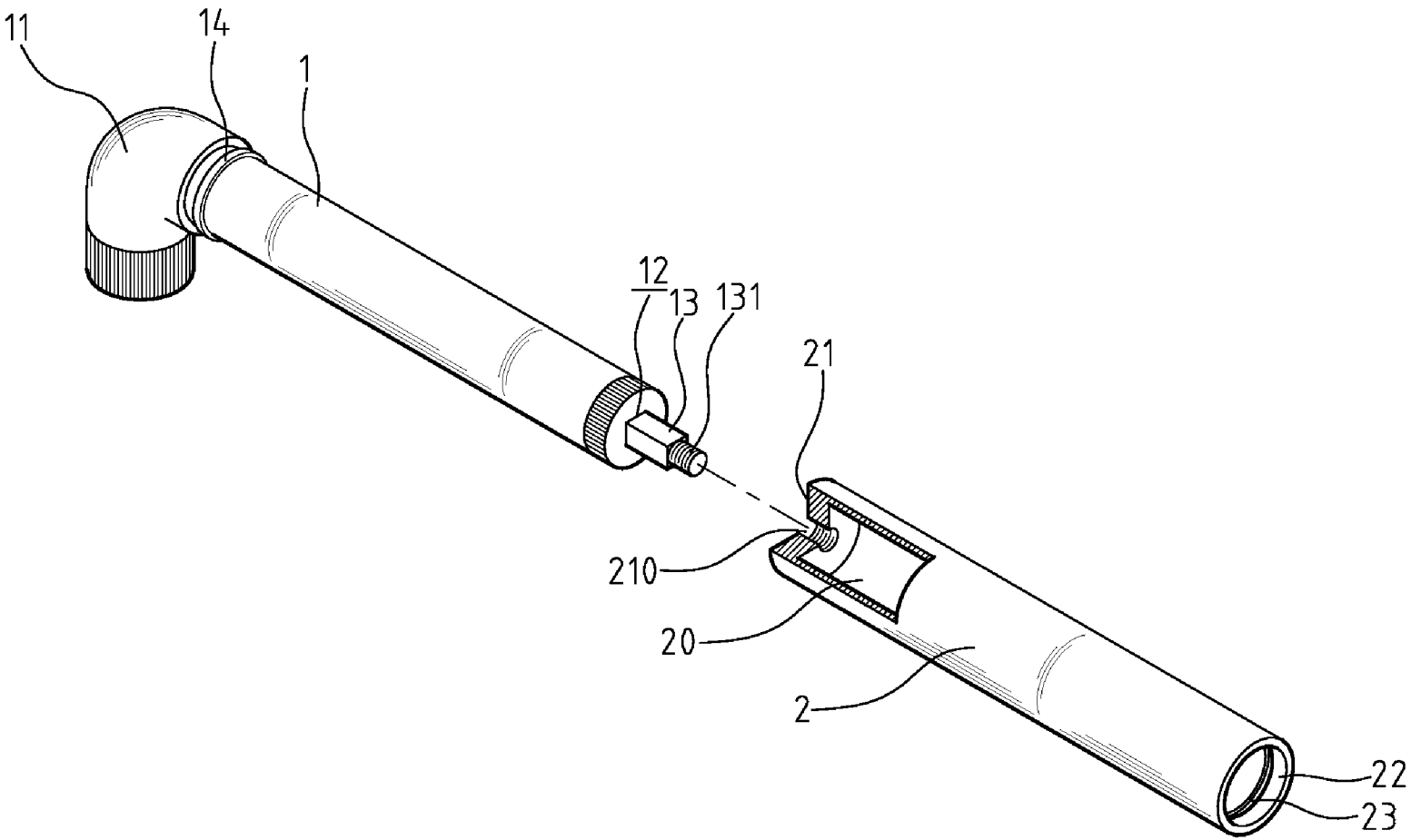
FIG. 3 is a perspective view showing the state when a stud on a shaft is to be locked to a tapped hole at one end of the handgrip of the present invention.
Figure 4:
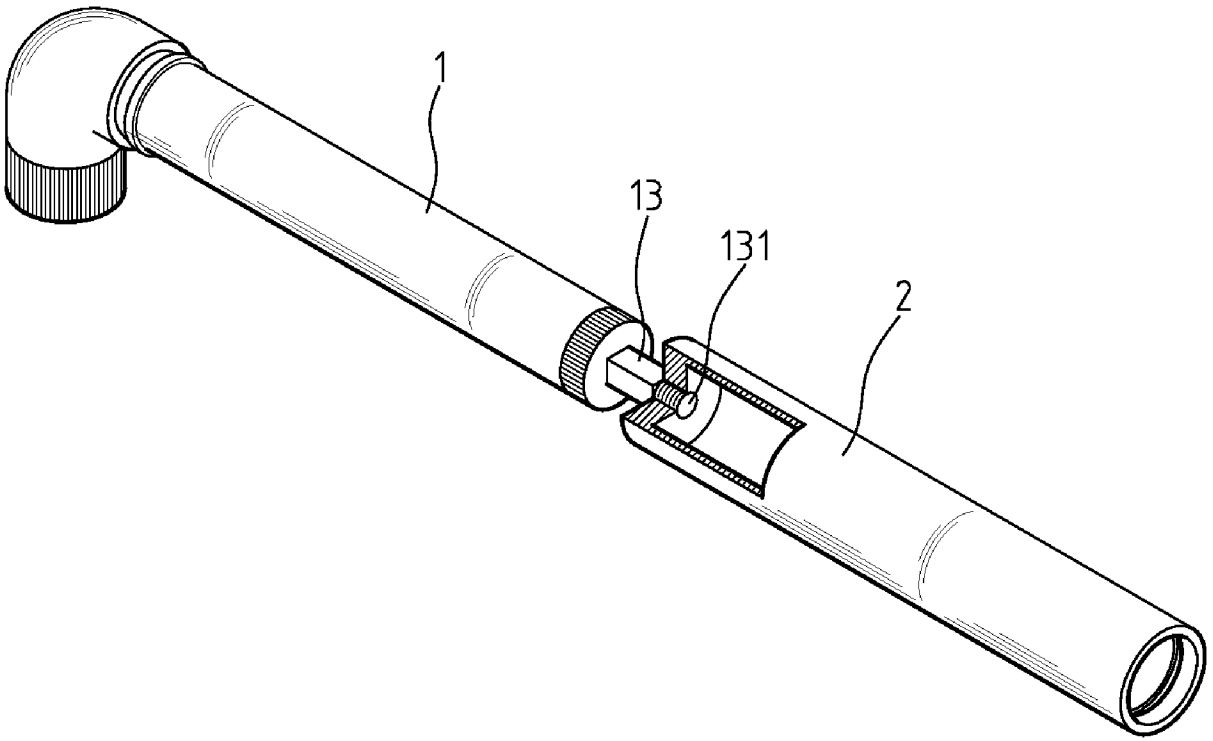
FIG. 4 is a perspective view showing the state when the shaft is engaged with the handgrip of the present invention.
Figure 5:
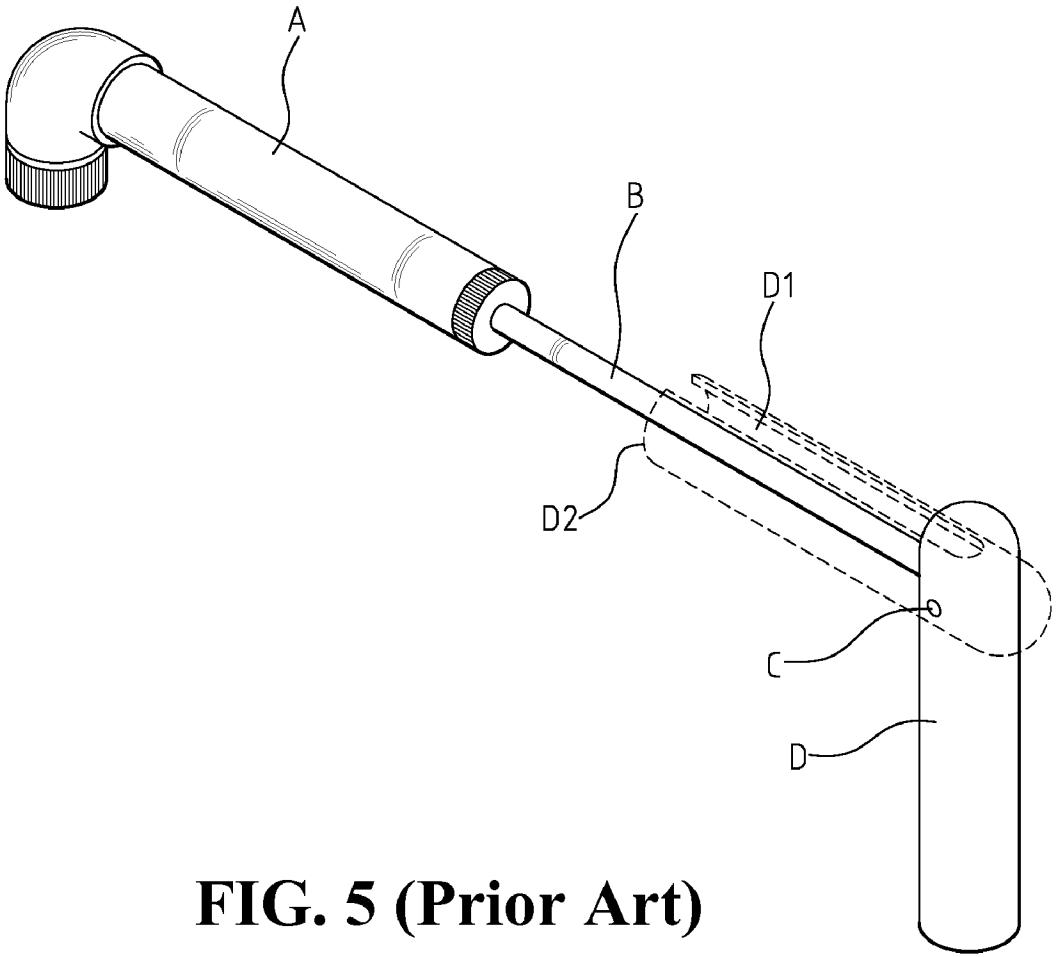
FIG. 5 (Prior Art)
FIG. 5 is a perspective view showing an inflator equipped with a conventional collapsible handgrip.

When the inflator is not in use, the cylinder 1 may be inserted through the opening 22 of the handgrip 2 to enter the inner space 20, then the stud 131 is locked in the tapped hole 210 to have the cylinder 1 fixed and received inside the handgrip 2 (as shown in FIG. 2). When the inflator is to be used, a user is supposed to unlock the handgrip 2 shown in FIG. 2 to detach it from the cylinder 1, and then, invert the handgrip 2 (shown in FIG. 3) and lock the stud 131 to the tapped hole 210 of the bottom wall 21 (shown in FIG. 4) to extend the length of the shaft 13 and meanwhile align the handgrip 2 and shaft 13 in line, so that the user may hold the cylinder 1 with one hand and the handgrip 2 with the other to move the shaft 13 axially for inflation.

Besides, in order to obtain a further positioning effect of the cylinder 1, an annular flange 14 is arranged on the outer wall of the cylinder 1 and an annular groove 23 corresponding with the flange 14 is formed in the inner wall of the handgrip 2, thereby the flange 14 will be squeezed into the annular groove 23 and the cylinder 1 is fixedly positioned when the cylinder 1 is entirely received in the handgrip 2. In the embodiment of the present invention, the flange 14 and the groove 23 are disposed adjacent to the outlet 11 and the opening 22, respectively, therefore, both ends of the handgrip 2 can be locked and positioned fixedly through the mated mechanism of the shaft and tapped hole and the paired flange and groove.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. An inflator comprising:

an air cylinder having a shaft extendcd out of said air cylinder and a stud formed at an end of said shaft; and a handgrip for removably attached to said air cylinder, said handgrip having a hollow tubular body, an opening at a first end and a bottom wall at a second end, said bottom wall having a tapped hole for receiving said stud;

wherein said air cylinder is receivable within said handgrip through said opening and said stud is locked and received in said tapped hole from an interior side of said bottom wall when said inflator is not in use, and said handgrip forms an extension or said shaft by locking said stud into said tapped hole from an exterior side of said bottom wall when said inflator is in use.

2. The inflator according to claim 1, wherein said shaft has a non-circular cross section so that said shaft can not be rotated within said air cylinder.

3. The inflator according to claim 1, wherein a flange is formed on an outer surface of said air cylinder and a groove is formed on an inner wall of said handgrip so that said flange is engageable with said groove for fixing said air cylinder in said handgrip.

* * * * *